US005467500A

United States Patent [19]

O'Hara et al.

[11] Patent Number: 5,467,500

[45] Date of Patent: Nov. 21, 1995

[54] STEERING MECHANISM FOR A CLEANING VEHICLE

[75] Inventors: Robert J. O'Hara, Denver, Colo.; Christopher M. Knowlton, West End, N.C.

[73] Assignee: AAR Corp., Elk Grove Village, Ill.

[21] Appl. No.: 9,816

[22] Filed: Jan. 27, 1993

[51] Int. Cl.[6] ..... A47L 11/283

[52] U.S. Cl. ..... 15/320; 15/339; 15/340.4; 280/103

[58] Field of Search ..... 15/4, 320, 340.1–340.4; 74/98; 280/47.11, 95.1, 96, 98, 103; 180/79, 79.3

[56] References Cited

U.S. PATENT DOCUMENTS

| | | | |
|---|---|---|---|
| 2,800,336 | 7/1957 | Major | 280/47.11 |
| 3,376,597 | 4/1968 | Boyd | 15/320 |
| 4,013,301 | 3/1977 | Gaskin | 280/95.1 |
| 4,683,973 | 8/1987 | Monjo | 280/47.11 |
| 4,942,638 | 7/1990 | Helm | 15/320 |
| 5,064,010 | 11/1991 | Masbruch | 15/340.2 |

*Primary Examiner*—David Scherbel
*Assistant Examiner*—Terrence R. Till
*Attorney, Agent, or Firm*—Harness, Dickey & Pierce

[57] ABSTRACT

A vehicle for moving in a longitudinal direction and cleaning a surface has a scrub brush, a cleaning fluid dispenser, a squeegee, drive means, and at least one steering wheel which is mounted to the vehicle such that it may be selectively turned for steering the vehicle. The vehicle is provided with a steering mechanism for turning the steering wheel, whereby turning a steering input member a specific angular magnitude in one direction causes the steering wheel to turn a greater angular magnitude in the opposite direction.

20 Claims, 2 Drawing Sheets

STEERING MECHANISM FOR A CLEANING VEHICLE

BACKGROUND AND SUMMARY OF THE INVENTION

The present invention relates generally to cleaning vehicles and more particularly to a steering mechanism for a cleaning vehicle.

Vehicles for cleaning various surfaces, for example floors, generally have at least one scrub brush, drive wheel, and steering wheel, as well as a cleaning fluid dispenser and a squeegee for picking up the cleaning fluid along with any dirt or debris from the surface to be cleaned.

Two general categories of cleaning vehicles are those on which an operator rides during operation, and those behind which the operator walks. Walk-behind vehicles must be steered from the rear of the vehicle, and are generally equipped with a laterally extending steering bar located at the rear of the vehicle.

In order to guide the cleaning vehicle around tight turns and corners, it is preferable to locate the steering wheels at the rear of the vehicle behind the drive wheels. It is generally conventional to turn the steering bar clockwise to indicate a clockwise turn of the vehicle. However, in a configuration where the steering wheels are located behind the drive wheels, the steering wheels must turn counterclockwise to cause the vehicle to turn clockwise. Steering systems exhibiting this type of reverse steering are generally known.

It is desirable that the cleaning vehicle be able to make sharp corners and tight turns, while simultaneously cleaning the surface with the scrubbing brushes immediately adjacent to a wall. Such sharp maneuvering often requires the steering wheels to turn through a steering wheel angle up to at least 90 degrees or more. However, it is awkward and inconvenient for an operator to turn the steering bar through such a large input angle. As a result, it is desirable to provide a steering mechanism for a cleaning vehicle whereby turning the steering bar a specific angular magnitude in one direction causes the steering wheels to turn a greater angular magnitude in the opposite direction, for both clockwise and counterclockwise turns.

The present invention provides a vehicle for moving in a longitudinal direction and cleaning a surface, having at least one scrub brush for cleaning the surface, a fluid dispenser for dispensing a cleaning fluid onto the surface, a squeegee for picking up the fluid from the surface, drive means for propelling the vehicle in the longitudinal direction, at least one steering wheel adapted for rotation around a horizontal steering wheel axis during said longitudinal motion which is mounted to the vehicle such that it may be selectively turned about a generally vertical axis for steering the vehicle, and a steering mechanism for turning the steering wheel which includes a steering input member, whereby turning the steering input member a specific angular magnitude in one direction causes the steering wheel to turn a greater angular magnitude in the opposite direction.

These and other various advantages and features of the present invention will become apparent from the following description and claims, in conjunction with the appended drawings:

DETAILED DESCRIPTION OF THE PREFERRED EMBODIMENTS

The following description of the preferred embodiments is merely exemplary in nature, and is in no way intended to limit the invention, or its application or uses.

Figure 1:
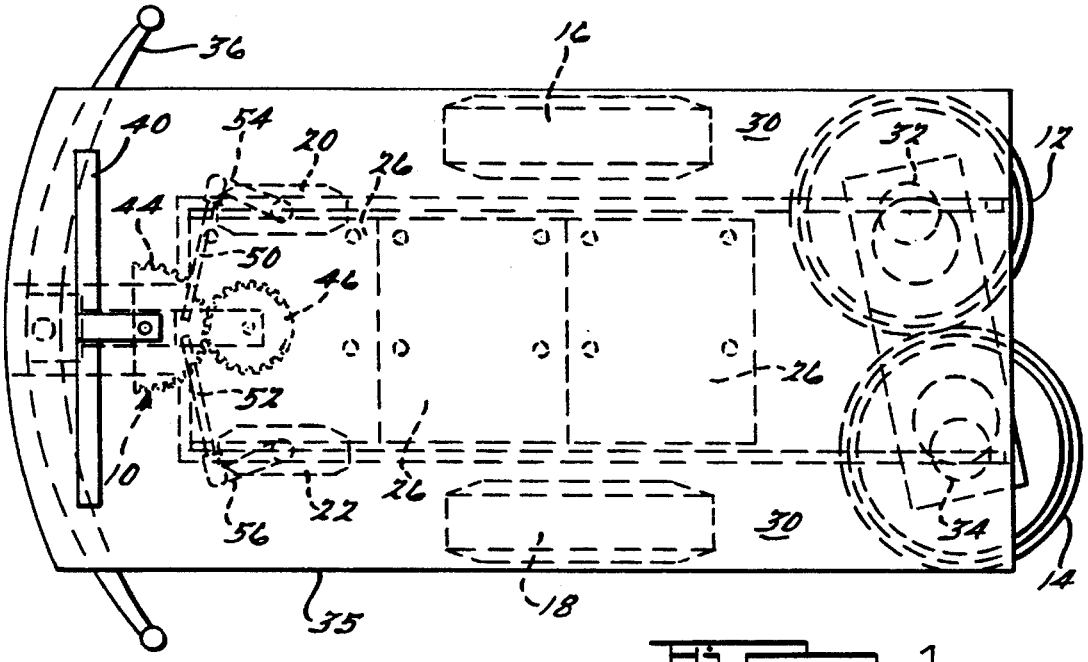
FIG. 1 is a plan view of a cleaning vehicle arranged according to the principles of the present invention.
Figure 2:
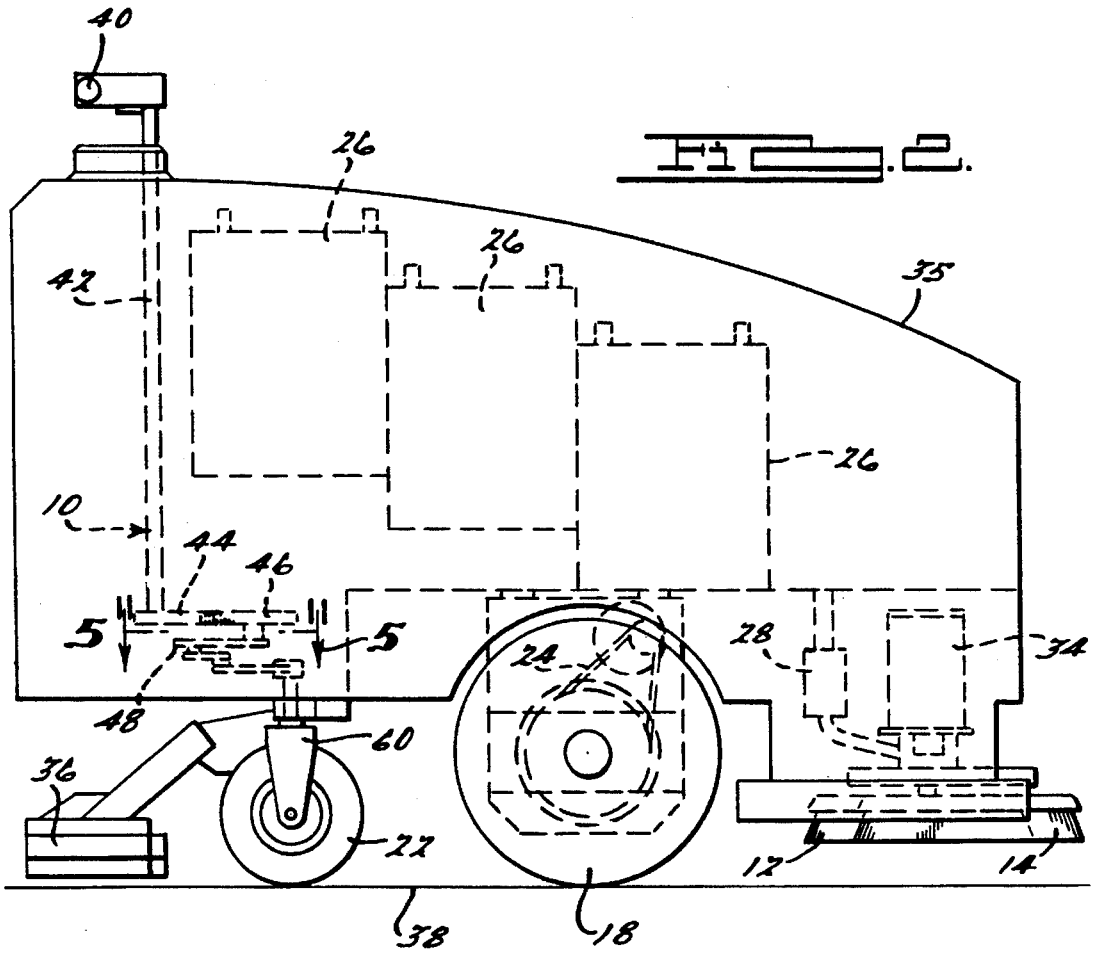
FIG. 2 is a side elevation of the cleaning vehicle of FIG. 1.

With reference to the drawings, a cleaning vehicle is shown in FIG. 1 having a steering mechanism 10, scrub brushes 12 and 14, driving wheels 16 and 18, steering wheels 20 and 22, drive means 24, batteries 26, fluid dispensing means 28, cleaning fluid tanks 30, motors 32 and 34 for rotating scrub brushes 12 and 14, a vehicle body 35, and a squeegee 36. Scrub brushes 12 and 14 are rapidly rotated around a generally vertical axis by motors 30 and 32. Dispenser 28 dispenses a cleaning fluid from cleaning fluid tank 30 onto a surface 38 to be cleaned. Batteries 26 provide power to drive means 24 as is known in the art. Drive means 24 propels drive wheels 16 and 18 in rotation around a horizontal driving axis to move the cleaning vehicle in a longitudinal direction. Scrub brushes 12 and 14 scrub surface 38 and dislodge dirt and other debris from surface 38. As the cleaning vehicle moves in the longitudinal direction, squeegee 36 picks up the cleaning fluid from surface 38, along with any dirt or debris dislodged by the scrub brushes 12 and 14. Scrub brushes 12 and 14, as well as squeegee 36, may be selectively raised or lowered with respect to the cleaning vehicle and surface 38, so that they may be raised from surface 38 when they are not in use.

Figure 3:
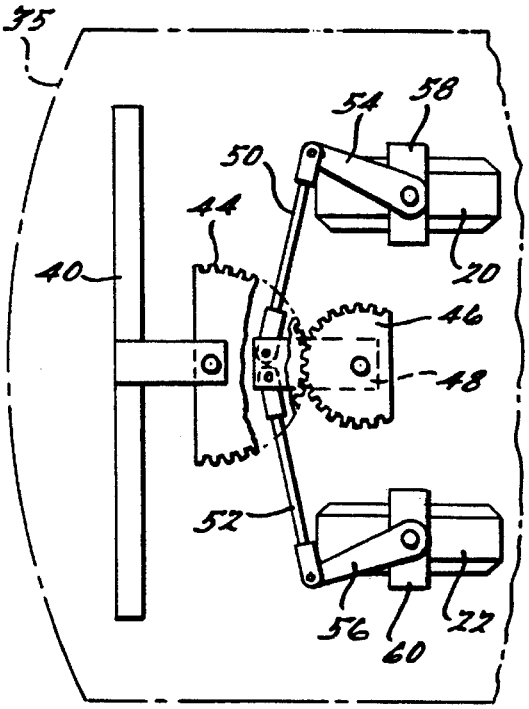
FIG. 3 is a plan view of a steering mechanism arranged according to the present invention.
Figure 4:
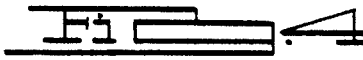
FIG. 4 is a plan view of the steering mechanism of FIG. 3 in a different position.
Figure 5:
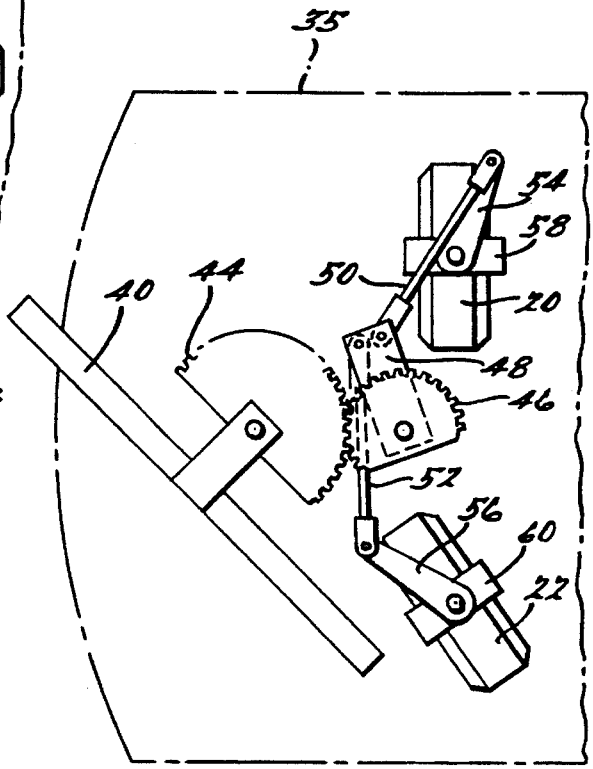
FIG. 5 is a plan view of a portion of a steering mechanism according to the present invention, looking from line 5—5 in FIG. 2.
Figure 5:
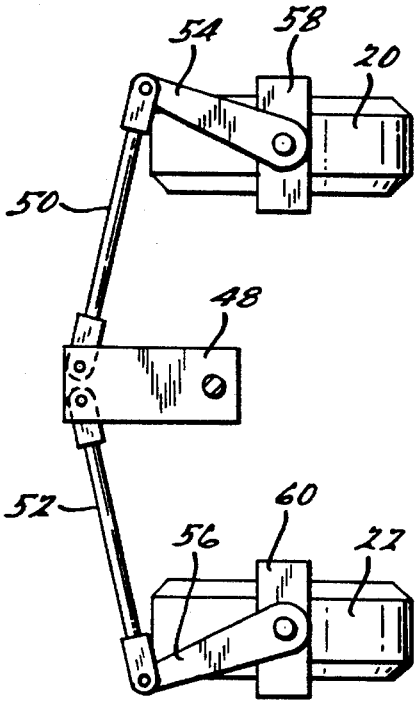

The novel steering mechanism 10 of the present invention is shown in greater detail in FIGS. 3 through 5, and includes a steering input member such as steering bar 40, torque transmission bar 42, input gear 44, output gear 46, rocker arm 48, first and second push rods 50 and 52 respectively, first and second steering lever arms 54 and 56, and steering wheel supports 58 and 60. Steering bar 40 and input gear 44 are both affixed to opposing ends of torque transmission bar 42 for conjunctive rotation. Input gear 44 is in meshing engagement with output gear 46, which has a smaller radius than input gear 44. Steering bar 40 and input gear 44 define an input angle; output gear 46 defines an output angle; and steering wheels 20 and 22 each define a steering wheel angle. The input angle, output angle, and each steering wheel angle are all defined to be zero degrees when steering mechanism 10 is in a configuration for steering the vehicle straight forward or backward.

When input gear 44 is rotated a specific angular magnitude in one direction, the output gear 46 therefore rotates greater angular magnitude in an opposite direction. Output gear 46 is affixed to one end of rocker arm 48, such that output 46 and rocker arm 48 rotate in conjunction. The outer end of rocker arm 48 is pivotably connected to a first end of both push rods 50 and 52, the other ends of which are each pivotably connected to steering lever arms 54 and 56 respectively. Steering lever arms 54 and 56 are affixed to steering wheel support 58 and 60 which are affixed to the axles of steering wheels 20 and 22. Steering wheels 20 and 22 rotate around horizontal steering wheel axes during longitudinal motion, and they may be selectively turned about a generally vertical axis by steering level arms 54 and 56 for steering the vehicle.

The novel configuration of steering mechanism 10 causes steering wheels 20 and 22 to turn a relatively large angular magnitude clockwise or to the right when steering bar 40 is turned a relatively small angular magnitude counterclockwise or to the left. Steering mechanism 10 thus enables an operator walking behind the cleaning vehicle during longitudinal movement to turn steering bar 40 to the left or counterclockwise to indicate a counterclockwise turn by the vehicle, because steering mechanism 10 causes steering wheels 20 and 22 to turn clockwise, and thus swings the rear of the vehicle to the right and resulting in a turn to the left as is shown in FIG. 4.

In addition, the sensitivity of steering mechanism 10 may be adjusted. The ratio of the input angle of input gear 44 to the output angle of output gear 46 equals the ratio of the radii of output gear 46 to input gear 44, and it can therefore be preselected simply by choosing appropriate sizes for input gear 44 and output gear 46. For example, input gear 44 may be formed with a radius equal to twice the magnitude of the radius of output gear 46, resulting in steering wheel angles of approximately 60 degrees for an input angle of steering bar 40 equal to approximately 30 degrees.

Steering mechanism 10 may be analyzed as a dual four-bar mechanism, in which rocker arm 48 forms one bar, push rods 50 and 52 each form a second bar, steering lever arms 54 and 56 each form a third bar, and a frame (not shown) of the cleaning vehicle forms a fourth or ground link. The relative lengths of rocker arm 48, push rods 50 and 52, steering lever arms 54 and 56, and their relative locations can of course be adjusted to provide for various steering wheel angles for a given input angle. In other words, if rocker arm 48 and steering lever arms 54 and 56 are all of equal length and extend parallel to one another, and push rods 50 and 52 extend parallel to each other, then they will form a dual parallelogram. In this configuration, steering wheels 20 and 22 will remain parallel to each other given any input angle of steering bar 40.

However, if steering wheels 20 and 22 remain parallel throughout all input angles, one of steering wheels 20 or 22 may drag. As a result, it is preferable to arrange steering mechanism 10 such that steering wheels 20 and 22 each rotate through different angles during a sharp turn so as to follow a circular path and prevent either steering wheel 20 or 22 from dragging. In a counterclockwise or left turn, steering wheel 20 is inside of steering wheel 22 during the turn. Inside steering wheel 20 should therefore preferably rotate through a greater steering wheel angle than outside steering wheel 22, as shown in FIG. 4.

The steering mechanism 10 of the present invention may also be configured for progressive steering, in which steering wheels 20 and 22 rotate through their respective steering wheel angles at a greater rate with respect to the output gear angle when the output gear angle equals a relatively large magnitude than when the output gear angle equals a relatively low angular magnitude. This type of progressive steering allows for a nonlinear relationship between the input angle and the steering wheel angles. During a slight turn in which the input angle is relatively small, steering wheels 20 and 22 will rotate through one angular magnitude for precise steering during an approximately straight path. However, when the input angle is much larger, steering mechanism 10 rotates steering wheels 20 and 22 through an even larger angular magnitude for ease of operation during very sharp turns.

The limited space inside vehicle body 35 may require an item to be located directly above the desired location for steering wheels 20 and 22. For example, a portion of drive means 24 such as batteries 26 or a portion of cleaning fluid dispensing means 28 such as fluid tanks 30 may be located above steering wheels 20 and 22. Another advantage of the present invention is that steering mechanism 10 allows steering bar 40 and torque transmission bar 42 to be longitudinally offset from steering wheels 20 and 22, thereby leaving more space for the placement of battery 26 directly above steering wheels 20 and 22.

It should be understood that an unlimited number of configurations of the present invention can be realized. The foregoing discussion discloses and describes merely exemplary embodiments of the present invention. One skilled in the art will readily recognize from the discussion and from the accompanying drawings and claims that various changes and modifications can be made without departing from the spirit and scope of the invention, as defined in the following claims.

What is claimed is:

1. A powered cleaning vehicle for moving in a longitudinal direction and cleaning a surface, comprising:

a steering wheel being mounted to said vehicle such that said steering wheel is selectively turned about a generally vertical axis for steering said vehicle;

a steering mechanism for turning said steering wheel having a steering input member being connected to an input gear, said input gear being in meshing engagement with an output gear, said output gear being connected to a first end of a rocker arm, a second end of the rocker arm being operatively connected to said steering wheel, whereby turning said steering input member a specific angular magnitude in one direction causes said steering wheel to turn a greater angular magnitude in an opposite direction;

cleaning means connected to said vehicle and for engaging said surface for cleaning said surface;

a plurality of wheels mounted to said vehicle and engaging said surface; and driving means mounted to said vehicle and engaging at least one of said wheels for propelling said vehicle in said longitudinal direction;

at least one of said wheels being a steering wheel.

2. The vehicle as set forth in claim 1, wherein said steering mechanism further comprises a torque transmission bar having a first and second end, said first end being affixed to said steering input member and said second end being affixed to said input gear, said output gear having a smaller radius than said input gear and being affixed to said first end of said rocker arm, a second end of which is connected to said steering wheel.

3. The vehicle as set forth in claim 2, wherein said second end of said rocker arm is pivotably connected to a first end of a push rod, a second end of said push rod being pivotably connected to a steering lever arm which is operatively connected to said steering wheel for turning said steering wheel about said generally vertical axis.

4. The vehicle as set forth in claim 1, further comprising a second steering wheel mounted to said vehicle, said first steering wheel being inside of said second steering wheel during a turn of said vehicle when moving in said longitudinal direction, said first and second steering wheels defining a first and second steering wheel angle respectively, said steering mechanism turning said steering wheels so that said first steering wheel angle is greater than said second steering wheel angle.

5. The vehicle as set forth in claim 2, wherein said input gear defines an input angle, said output gear defines an output angle, and said steering wheel defines a steering wheel angle, said steering mechanism being adapted for progressive steering and operating to increase said steering wheel angle at a greater rate with respect to said output gear angle when said output gear angle equals one angular magnitude than when said output gear angle equals a lesser angular magnitude.

6. The vehicle as set forth in claim 1, which further comprises at least two driving wheels mounted to said vehicle and each located in a position leading said steering wheel.

7. The vehicle as set forth in claim 1, wherein said steering mechanism is accessible from behind said vehicle during said longitudinal movement.

8. The vehicle as set forth in claim 1, further comprising a drive means connected to said vehicle and located above said steering wheel, said steering input member being longitudinally offset from said steering wheel.

9. The vehicle as set forth in claim 1, further comprising a cleaning means connected to said vehicle and located above said steering wheel, said steering input member being longitudinally offset from said steering wheel.

10. A cleaning vehicle for moving in a longitudinal direction and cleaning a surface, comprising:

a steering wheel being mounted to said vehicle such that said steering wheel is selectively turned about a generally vertical axis for steering said vehicle; and a steering mechanism for turning said steering wheel having a steering input member, a torque transmission bar having a first and second end, said first end being affixed to said steering input member and said second end being affixed to an input gear, said input gear being in meshing engagement with an output gear having a smaller radius than said input gear, said output gear being affixed to a first end of a rocker arm, a second end of which is operatively connected to said steering wheel, whereby turning said steering input member a specific angular magnitude in one direction causes said steering wheel to turn a greater angular magnitude in an opposite direction.

11. The vehicle as set forth in claim 10, wherein said second end of said rocker arm is pivotably connected to a first end of a push rod, a second end of said push rod being pivotably connected to a steering lever arm which is operatively connected to said steering wheel for turning said steering wheel about said generally vertical axis.

12. The vehicle as set forth in claim 10, further comprising a second steering wheel mounted to said vehicle, said first steering wheel being inside of said second steering wheel during a turn of said vehicle when moving in said longitudinal direction, said first and second steering wheel defining a first and second steering wheel angle respectively, said steering mechanism turning said steering wheels so that said first steering wheel angle is greater than said second steering wheel angle.

13. The vehicle as set forth in claim 10, wherein said input gear defines an input angle, said output gear defines an output angle, and said steering wheel defines a steering wheel angle, said steering mechanism being adapted for progressive steering and operating to increase said steering wheel angle at a greater rate with respect to said output gear angle when said output gear angle equals one angular magnitude than when said output gear angle equals a lesser angular magnitude.

14. The vehicle as set forth in claim 10, which further comprises at least two driving wheels mounted to said vehicle, each wheel being located in a position leading said steering wheel.

15. The vehicle as set forth in claim 10, wherein said steering input member may be controlled from behind said vehicle during said longitudinal movement.

16. The vehicle as set forth in claim 10, further comprising drive means mounted to said vehicle and located above said steering wheel, said steering input member being longitudinally offset from said steering wheel.

17. The vehicle as set forth in claim 10, further comprising a fluid dispensing means mounted to said vehicle wherein a portion of said fluid dispensing means is located above said steering wheel, said steering input member being longitudinally offset from said steering wheel.

18. The vehicle as set forth in claim 10, hich further comprising:

as least one scrub brush mounted to said vehicle and adapted for rotation around a generally vertical axis;

fluid dispensing means mounted to said vehicle for dispensing a cleaning fluid onto said surface;

a squeegee mounted to said vehicle for picking up said fluid from said surface;

a plurality of wheels mounted to said vehicle and engaging said surface; and drive means mounted to said vehicle and engaging at least one of said wheels for propelling said vehicle in said longitudinal direction;

at least one of said wheels being a steering wheel.

19. A battery powered cleaning vehicle, comprising:

scrubbing means mounted to said vehicle and adapted for rotation around a generally vertical axis;

fluid dispensing means mounted to said vehicle for dispensing a cleaning fluid onto said surface;

a squeegee means mounted to said vehicle and for picking up said fluid from said surface;

multiple wheel means mounted to said vehicle and engaging said surface;

drive means mounted to said vehicle and engaging one of said wheel means for propelling said vehicle in a longitudinal direction;

steering wheel means being mounted to said vehicle such that said steering wheel is selectively turned about a generally vertical axis for steering said vehicle; and steering mechanical means mounted to said vehicle for turning said steering wheel, said steering mechanism means comprising:

a steering input number;

a torque transmission bar having a first and second end, said first end being affixed to said steering input member and said second end being affixed to an input gear;

said input gear being in meshing engagement with an output gear having a smaller radius than said input gear;

said output gear being affixed to a first end of a rocker arm, a second end of which is operatively connected to said steering wheel, whereby turning said steering input member a specific angular magnitude in one direction causes said steering wheel to turn a greater angular magnitude in an opposite direction.

20. The vehicle as set forth in claim 10, further comprising:

at least one scrub brush adapted for rotation around a generally vertical axis;

fluid dispensing means for dispensing a cleaning fluid onto said surface; and a squeegee for picking up said fluid from said surface.

* * * * *